United States Patent [19]

Borgeaud et al.

[11] 4,273,055

[45] Jun. 16, 1981

[54] RAILWAY VEHICLE TRACTION AND BRAKING FORCE TRANSMITTING SYSTEM

[75] Inventors: Gaston Borgeaud, Winterthur; Johann K. Pfister, Dietlikon, both of Switzerland

[73] Assignee: Schweizerische Lokomotiv-und Maschinenfabrik, Winterthur, Switzerland

[21] Appl. No.: 943,306

[22] Filed: Sep. 18, 1978

[30] Foreign Application Priority Data

Sep. 20, 1977 [CH] Switzerland ..... 011452/77

[51] Int. Cl.[3] ..... B61F 3/04; B61F 5/16; B61F 5/22; B61F 5/50

[52] U.S. Cl. ..... 105/199 F; 105/199 C; 105/199 R; 105/210; 308/223

[58] Field of Search ..... 105/165, 166, 167, 168, 105/171, 199 R, 199 F, 209, 199 C, 210; 308/223

[56] References Cited

U.S. PATENT DOCUMENTS

| | | | |
|---|---|---|---|
| 719,496 | 2/1903 | Norwood | 308/223 |
| 1,585,101 | 5/1926 | Krüger | 105/209 |
| 3,121,402 | 2/1964 | Julien | 105/171 |
| 3,352,256 | 11/1967 | Saima | 105/199 R |
| 3,547,046 | 12/1970 | Lich | 105/199 R |
| 3,799,066 | 3/1974 | Jackson | 105/199 F X |
| 3,828,692 | 8/1974 | Kreissig | 105/199 F X |
| 4,040,360 | 8/1977 | Jackson | 105/199 R X |
| 4,170,179 | 10/1979 | Vogel | 105/199 R X |

FOREIGN PATENT DOCUMENTS

| | | | |
|---|---|---|---|
| 703819 | 3/1941 | Fed. Rep. of Germany | 105/168 |
| 587028 | 1/1978 | U.S.S.R. | 105/168 |

*Primary Examiner*—Howard Beltran
*Attorney, Agent, or Firm*—Kenyon & Kenyon

[57] ABSTRACT

The low slung traction means serves to transmit traction or braking forces between the rail vehicle body and the supporting undercarriage. In one embodiment, the traction means has a horizontal intermediate member connected to the undercarriage via inclined rods and connected to the body via a second longitudinal connecting rod. In addition, the intermediate rod is coupled to the vehicle body via a guide means formed by a linkage. The traction and braking forces are transmitted exactly at the force attack point given by the imaginary intersection of the inclined rods and the moment exerted on the intermediate rod by the traction and/or braking forces is compensated by a corresponding reaction moment via the guide linkage. Other embodiments utilize transverse cross-pieces, T-shaped intermediate members, lever cross-intermediate members and the like.

15 Claims, 16 Drawing Figures

RAILWAY VEHICLE TRACTION AND BRAKING FORCE TRANSMITTING SYSTEM

The invention relates to apparatus for transmitting traction and braking forces between a undercarriage and a body of a railroad vehicle.

Heretofore, rail vehicles have been known in which traction and braking forces have been transmitted between a vehicle body and an undercarriage (truck) supporting the body via low-slung traction devices which include at least one connecting rod movably linked to the undercarriage or body and directed lengthwise of the body. The rod is also coupled to the other one of the undercarriage and body via a movable intermediate member. In one known device, as described in U.S. Pat. No. 3,828,692, a pair of inclined tie rods are connected via a transversely arranged coupler which is linked to the vehicle body or undercarriage to rotate about a vertical axis. In this case, the imaginary point of attack of the forces to be transmitted is, in the static condition, in the vicinity of the height of the upper edge of the track where the imaginary extensions of the tie rods cross. However, as the body is sprung relative to the undercarriage, the height of this force attack point can change. As a result, corresponding axle load relief can occur, particularly upon starting.

Accordingly, it is an object of the invention to provide a traction means for transmitting traction and braking forces which is not influenced by a vertical motion of a rail vehicle body relative to a supporting undercarriage.

It is another object of the invention to retain an imaginary point of attack of transmitted traction and braking forces between a rail vehicle body and an undercarriage at a constant height.

It is another object of the invention to counteract any axle load relief on the wheels of a rail vehicle undercarriage.

It is another object of the invention to transmit traction and braking forces between a vehicle body and a supporting undercarriage practically completely independently of angular movements.

It is another object of the invention to provide a traction means for transmitting traction and braking forces which is of particularly compact construction.

Briefly, the invention provides a traction means for transmitting traction and braking forces between a rail vehicle body and an undercarriage supporting the body on a rail surface. The traction means includes at least one connecting rod movably connected to one of the body and undercarriage and disposed longitudinally of the body, a movable intermediate member pivotably connected to the other of the body and undercarriage about a substantially transverse axis and connected to the connecting rod, and means for vertically guiding the intermediate member relative to one of the body and undercarriage.

Because the intermediate member is arranged to be movable in height, the forces to be transmitted act at a predetermined, height-stable, imaginary transmission point in practically any operating position and any motion phase of the coupled vehicle parts. Correspondingly, uncontrolled load relief of individual wheel set axles of the track is prevented.

In one embodiment of particularly simple construction, which requires little maintenance and ensures an advantageously simple flow of forces, the intermediate member is in the form of a bar-shaped guide rod directed substantially in the longitudinal direction of the vehicle.

In a further embodiment, load relief of the axles can be reduced to practically negligibly small values if the intermediate member is coupled to the vehicle part (vehicle body or undercarriage) via a linkage having a guide rod which is intended for the transmission of a reaction force which serves to generate a reaction moment which counteracts a corresponding moment caused by the traction or braking force.

In a further embodiment, an arrangement particularly advantageous for compensating the reaction moment is obtained wherein a pair of oppositely directed connecting rods are inclined downwardly toward the center of the undercarriage and are connected between and to the vehicle part (body or undercarriage) and the intermediate member while the connecting rod and guide rod are in parallel and connected to the intermediate member at different elevations.

To ensure smooth transmission of forces, as much unaffected as possible by angular movements of the undercarriage relative to the vehicle body in negotiating curves, the intermediate member has a portion for the connecting rods, which is at least approximately arranged in the center lengthwise and extends as a bar substantially in the lengthwise direction of the vehicle.

According to one embodiment of the invention, the linkage connecting two parts (body and undercarriage) of the vehicle can be guided substantially in a plane parallel to the longitudinal center plane of the respective vehicle part if the connection between the intermediate member and the other vehicle part (vehicle body or undercarriage) has bearing parts rotatably coordinated about a vertical axis. Accordingly, the forces can be transmitted between the two vehicle parts practically completely independently of angular movements.

According to a further embodiment of the invention, an apparatus of particularly compact construction can be obtained, which permits, in particular, installation outside the central region of the undercarriage, if the two connecting rods are arranged on top of each other (i.e. in parallel) and if the intermediate member is formed of two two-armed levers which are linked to the other vehicle part (vehicle body undercarriage). Each lever is also connected at one end to a respective one of the connecting rods and at an opposite end to each other. Also, one of the levers has a lever arm of a different length from the remaining lever arms. Because of the unequally long lever arms of the one lever associated with the two connecting rods, the force transmitted by the one respective connecting rod, if the vehicle body is sprung relative to the undercarriage, is compensated by a correspondingly smaller or larger counter force, which is transmitted by the other connecting rod. Accordingly, the undercarriage is rotated about a transverse axis which is at the height level given by the ratio of the lever arms, preferably in the vicinity of the upper track edge. Accordingly, the imaginary transmission point of the forces lies in the vicinity of this transversel axis, so that no load relief moment can act on the wheel set axles, although the connecting rods are arranged not inclined but parallel to each other.

The subject matter of the invention can be combined in a simple manner with the body support, if the intermediate member is a cross-piece which is suspended from the truck by means of pendulums and is intended to accommodate support springs for the vehicle body, or is firmly connected to such a traverse.

These and other objects and advantages of the invention will become more apparent from the following detailed description and appended claims taken in conjunction with the accompanying drawings in which:

Figure 1:
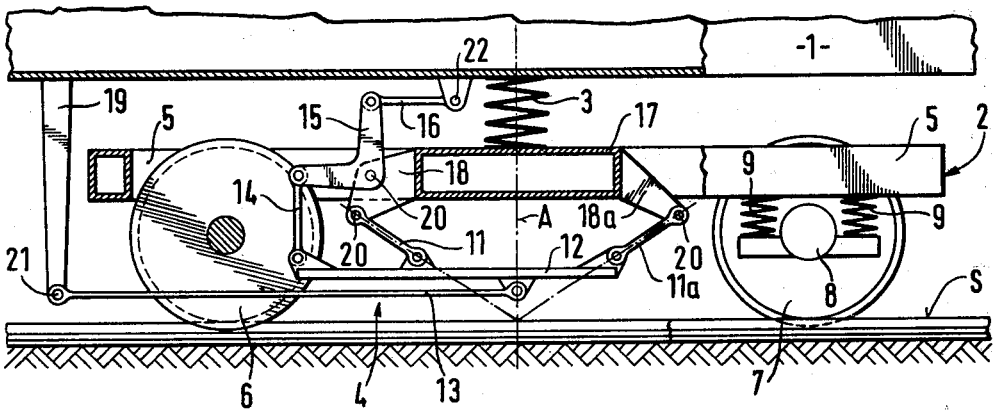
FIG. 1 illustrates a partial longitudinal view of a rail vehicle employing a traction means according to invention.
Figure 15:
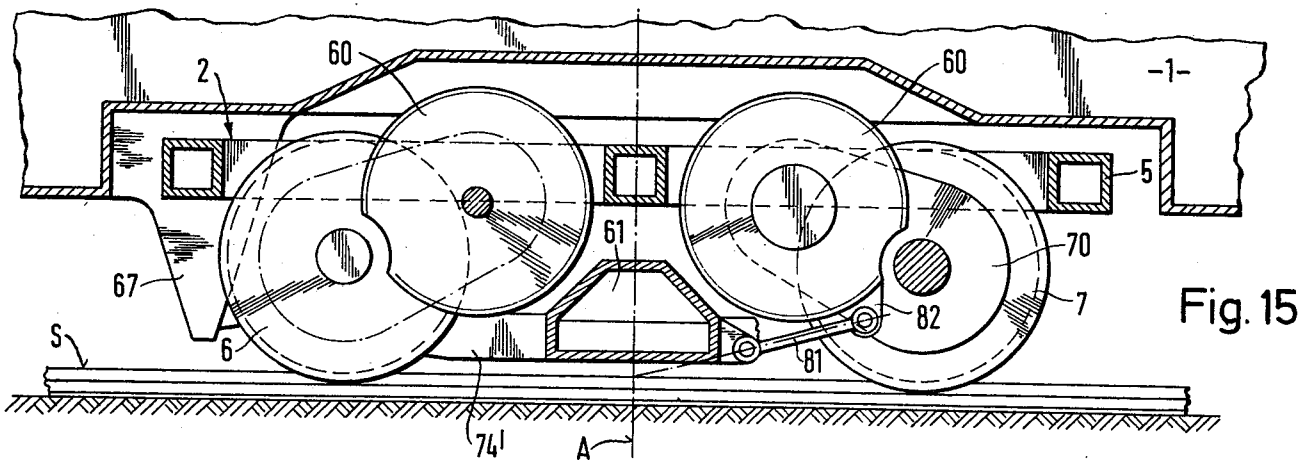
Figure 16:
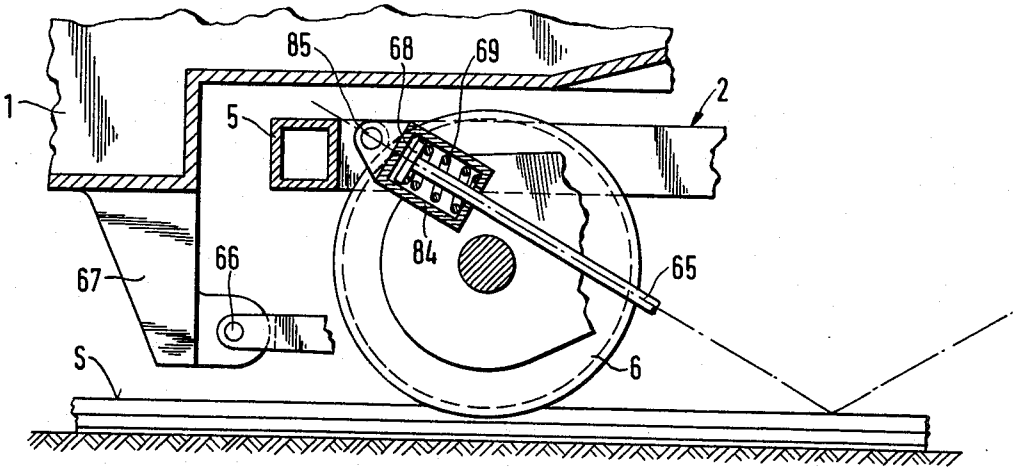

FIG. 15 lillustrates a view similar to FIG. 1 of a traction means employing a single tie rod linked to a cross-piece and a motor in accordance with the invention; and FIG. 16 illustrates a partial view of a traction means employing a spring cushioned tie rod in accordance with the invention.

In the accompanying drawings, like reference characters indicate like parts.

Referring to FIG. 1, the rail vehicle includes a vehicle body 1 which is supported on two undercarriages (trucks)2, only one of which is shown for simplicity. The body 1 is supported on each undercarriage 2 via a pair of springs 3 arranged on each side.

Each undercarriage 2 can rotate about an imaginary vertical axis assumed in the center of the undercarriage 2 and is connected to the vehicle body 1 via a low-slung traction means 4 for transmitting traction and braking forces. Each undercarriage 2 contains a frame 5 and two wheel sets 6, 7 with axle bearings 8, on which the frame 5 is supported via springs 9.

The low-slung traction transmitting means 4 comprises a linkage which is arranged substantially in the vicinity of the longitudinal center plane of the undercarriage and contains two guide or tie rods 11, 11*a* inclined downward toward the center of the undercarriage 2, a horizontal intermediate member 12, such as a beam, connecting the ends of the guide rods 11, 11*a*, and a horizontal connecting rod 13 linked to the intermediate beam 12. The intermediate beam 12 is movably coupled to the vehicle body 1 via a guide means formed of a linkage including an upright guide rod 14, an angle lever 15 and a horizontally arranged guide rod 16. The guide rods 11, 11*a* are pivoted at a central cross piece 17 of the undercarriage frame 5 on brackets 18, 18*a* about transverse pins 20 and are inclined to each other in each longitudinal direction by an angle, the apex of which is situated approximately at the height of the upper edge of the track S (in the vicinity of the transverse center plane A of the undercarriage 2). The lower ends of the guide rods 11, 11*a* are linked to the intermediate beam 12. The connecting rod 13 is linked to one end to the intermediate beam 12 in the vicinity of the transverse center plane A and at the other end is pivoted at a bracket 19 extending downward from the vehicle body 1 about a transverse pin 21. The guide rods 14, 16 are linked to respective arms of the lever 15, which in turn is fulcrumed at the bracket 18. The other end of the guide rod 16 is linked at the bottom of the vehicle body 1 at a transverse pin 22.

The joints between the individual parts 11 to 16 of the low-slung traction means 4, as well as between these parts and the vehicle body 1 or the frame 5, are provided in a manner known per se with rubber inserts. This ensures mobility to all sides of the parts which are thereby movably connected without sliding parts and, thus, makes possible relative movements about vertical and horizontal axes between the vehicle body 1 and the undercarriage 2, which occur, for instance, when curves are negotiated.

The undercarriage 2 is positively connected to the vehicle body 1 via the two guide rods 11, 11*a*, the intermediate beam 12 and the connecting rod 13 in the lengthwise direction of the vehicle. Accordingly, the traction and braking forces acting between the two vehicle parts 1, 2 are transmitted kinematically exactly at the force attack point given by the imaginary intersection of the extended axes of the guide rods 11, 11*a* in the plane of the top edges of the rails S. The moment exerted on the intermediate beam 12 by the traction and braking forces is compensated by a corresponding reaction moment via the linkage 14, 15 and 16.

The guide means formed by the guide rods 14, 16 and the angle lever 15, serves to guide the intermediate beam 12 vertically to the vehicle body 1 so that vertical relative movements of the vehicle body 1 with respect to the undercarriage 2, for instance, if the vehicle body 1 moves on the springs, are taken up by corresponding compensatory movements of these linkage parts 14, 15, 16. Accordingly, the position of the guide rods 11, 11*a* and the intermediate beam 12 relative to the frame 5 remains practically unchanged, since the height of the imaginary force attack point, uninfluenced by the secondary spring system of the vehicle body 1, changes only in accordance with small movements of the frame S relative to the wheel set axles resulting from the primary spring system, i.e., by small amounts which are practically negligible for railroad operations. The imaginary force attack point therefore remains practically in the vicinity of the height of the upper edge of the track S in every phase of the operation.

Figure 2:
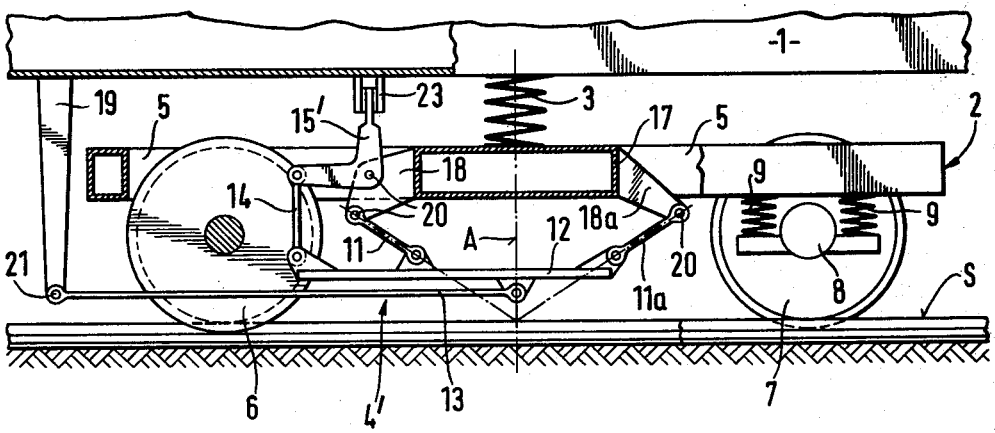
FIG. 2 illustrates a view similar to FIG. 1 of a modified traction means according to the invention.

The railroad vehicle according to FIG. 2 corresponds in substance to the construction as per FIG. 1, with the difference that a low-slung traction means 4' with an angle lever 15' is used. In this case, the lever 15' is vertically guided by one vertical arm in a slide guide 23 provided at the vehicle body 1 between two slide surfaces set transversely to the lengthwise direction of the vehicle. The reaction moment to the traction and braking forces is therefore introduced via the slide guide 23. Accordingly, vertical movements of the vertical body 1 relative to the undercarriage 2 are made possible.

Figure 3:
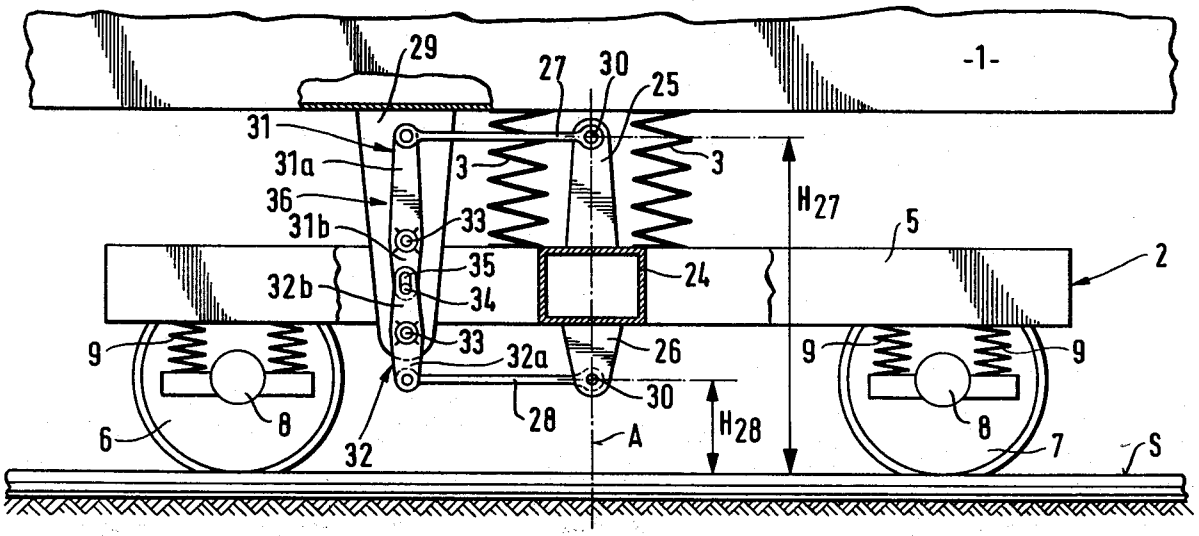
FIG. 3 illustrates a view similar to FIG. 1 of a modified traction means employing an intermediate member formed of double-armed levers in accordance with the invention.

Referring to FIG. 3, the frame 5 has a central cross piece 24, which is equipped with an upward-extending bracket 25 and a downward-extending bracket 26. The two brackets 25, 26 are linked at two pins 30 to two guide rods 27, 28 which are arranged on top of each other, i.e. in parallel, and extend substantially parallel to each other in the static condition, in the same longitudinal direction. These guide rods 27, 28 are movably coupled via an intermediate member 36 formed by two two-armed levers 31, 32. The levers 31, 32 are pivoted on a bracket 29 of the vehicle body 1, each at a transverse pin 33, and their lever arms 31*a*, 31*b* and 32*a*, 32*b* are substantially in-line in the static condition shown. In the example shown, the lever arm 31*a* associated with the upper guide rod 27 is longer than the lever arm 32*a* associated with the lower guide rod 28; the lever arm 32, in turn, has approximately the same length as the lever arms 31*b*, 32*b* facing each other. The lever arms 31*b*, 32*b* are coupled via a pin 34 arranged on the lever arm 31*b*; the pin 34 is movably guided in an elongated slot 35 which is provided in the lever arm 32*b* and extends in the long dimension of the lever arm 32*b*.

The ratio of the lengths of the lever arms 31*a*, 31*b*, 32*a*, 32*b* relative to each other is substantially determined by the ratio of the elevations of the guide rods 27, 28 above the upper edge of the track S. The relation applies:

$$(L_{31a}/L_{31b})\times(L_{32b}/L_{32a})\doteq H_{27}/H_{28},$$

where L are the respective lengths of the lever arms 31*a*, 31*b*, etc., and H the respective heights of the linkage points of the guide rods 27, 28.

In the embodiment described, with the lever arms 31*b*, 32*a* and 32*b* of equal length among themselves, the lengths of the lever arms 31*a*, 31*b* actually are directly proportional to the ratio of the elevations of the guide rods 27, 28.

Because the linkage is constructed in accordance with the relation cited, the forces acting between the undercarriage 2 and the vehicle body 1 are likewise transmitted in an imaginary attack point, which lies approximately at the height of the upper edge of the track S in the vicinity of the transverse center plane A. As a result, load relief of the axles is avoided. The joints can be provided, in the manner known, with elastic inserts.

Figure 4:
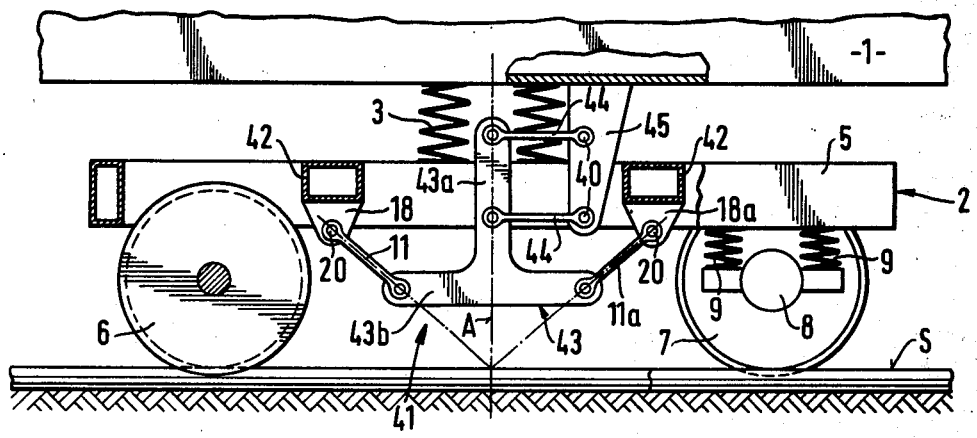
FIG. 4 illustrates a view similar to FIG. 1 of a further modified traction means employing a T-shaped intermediate member in accordance with the invention.

Referring to FIG. 4, the low slung traction means 41 can be constructed with a T-shaped intermediate member 43 arranged in the region between two cross pieces 42 of the frame 5. This member 43 is formed by an upright arm 43*a* arranged in the vicinity of the transverse center plane A, and a horizontal arm 43*b*, which connects the two tie rods 11, 11*a* movably to each other. Two parallel guide rods 44 are linked to the arm 43*a* and, in the static condition, are parallel and on top of each other. The other ends of the rods 44 each pivoted about a transverse pin 40 to a bracket 45 which extends from the vehicle body 1 into the space between the two cross pieces 42.

The intermediate member 43 can move vertically relative to the vehicle body 1 because of the two guide rods 44, and is thereby guided substantially independently of the secondary spring system. Thus, the position of the body 1 relative to the upper edge of the track S, influenced only by the primary spring system of the undercarriage 2, remains practically unchanged.

Figure 5:
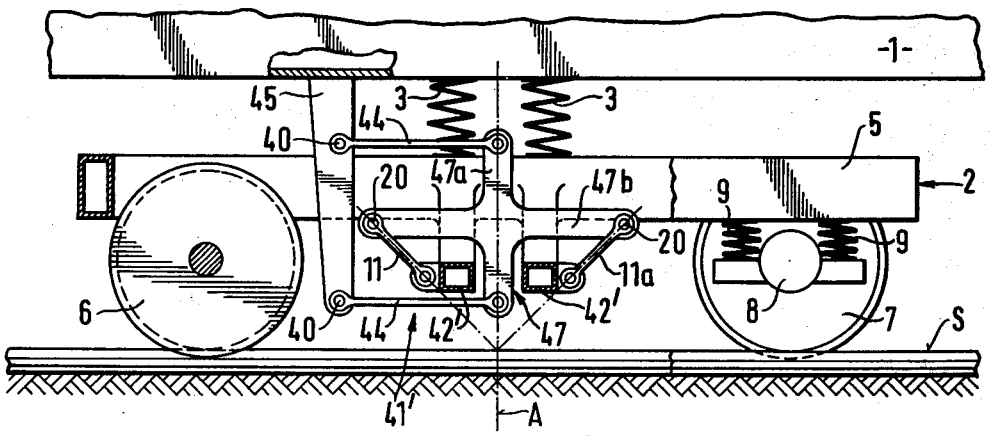
FIG. 5 illustrates a view similar to FIG. 1 of a further modified traction means employing a lever cross as an intermediate member in accordance with the invention.

Referring to FIG. 5, the low-slung traction means 41' corresponds in substance to that as per FIG. 4. This traction means 41' has an intermediate member 47 constructed as a lever cross with a vertical arm 47*a* arranged in the vicinity of the transverse center plane A and a horizontal arm 47*b*, which connects the upper ends of the guide rods 11, 11*a*. The guide rods 11, 11*a* are linked at their lower ends to low-lying portions of two cross pieces 42' which extend on both sides of the vertical arm 47*a* and are inclined from there upward at an angle, the apex of which also is at the height of the upper edges of the track S. The bracket 45 connected to the parallel guide rods 44 extends as shown into the space between the wheel set 6 and the adjacent cross piece 42'.

Figure 6:
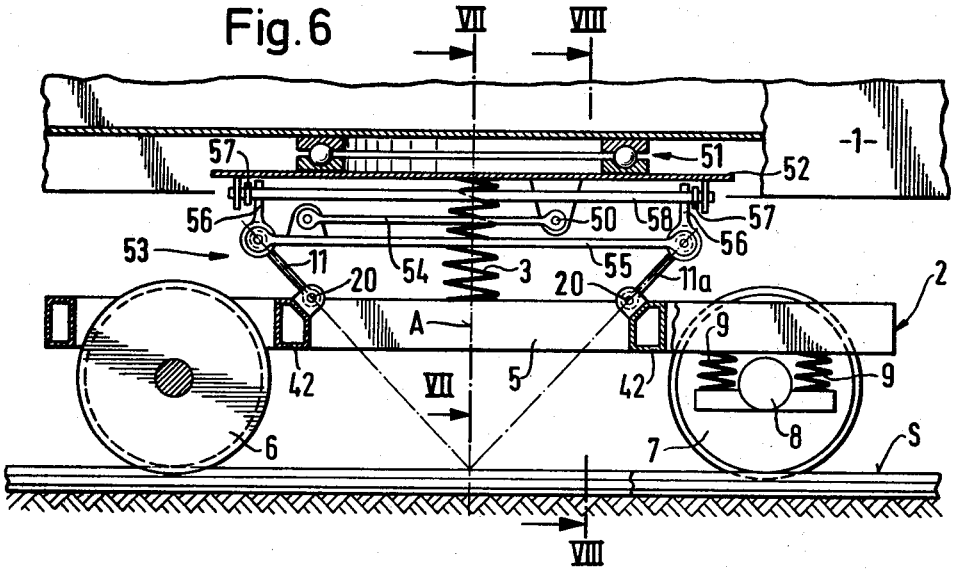
FIG. 6 illustrates a view similar to FIG. 1 of a low-slung traction means which employs a rotary bearing in accordance with the invention.
Figure 7:
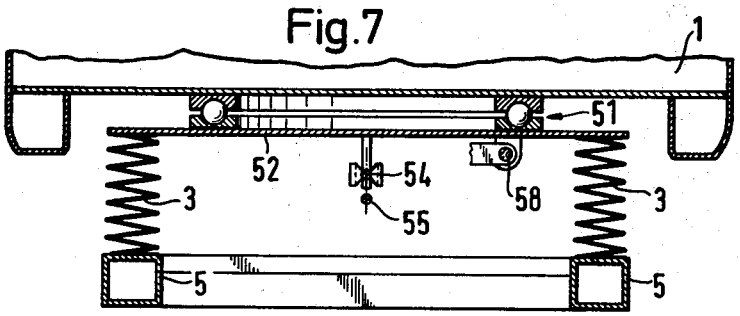
FIG. 7 illustrates a view taken on line VII—VII of FIG. 6.
Figure 8:
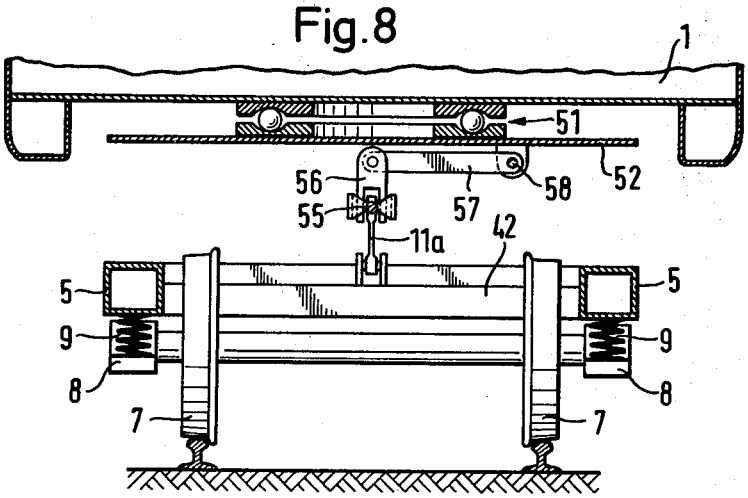
FIG. 8 illustrates a view taken on line VIII—VIII of FIG. 7.

Referring to FIGS. 6, 7 and 8, the vehicle body 1 can be supported on a rotary ball bearing track 51 which is arranged on a platform 52 supported via lateral springs 3 on the undercarriage 2. In order to transmit the traction and braking forces, a device 53 is provided which contains a linkage arranged in the lengthwise center plane of the truck. This linkage comprises a guide rod 54 which is linked to the underside of the platform 52 and is pivoted about a transverse axis 50; an intermediate beam 55 which is movably connected to the guide rod 54 and extends in the lengthwise direction; and the two guide rods 11, 11*a* linked to the ends of the intermediate beam 55. The guide rods 11, 11*a* are each linked, inclined upward, to one of the cross pieces 42 of the frame 5. The intermediate beam 55 is coupled via two holders 56, linked to both of the ends of the beam 55, to two transverse rods 57. These rods 57 are connected (FIG. 8) to a torsion shaft 58 in a manner to be secured against rotation. The shaft 58 is arranged parallel to the lengthwise center plane of the undercarriage and is rotatably supported at the underside of the platform 52.

The vertical movements of the platform 52 connected to the vehicle body 1 relative to the undercarriage 2 are taken up by compensating movements of the transverse rods 57 which are rigidly connected via the torsion shaft 58. Accordingly, the intermediate beam 55 is automatically guided parallel to the torsion shaft 58 and is thereby always held in the vicinity of the lengthwise center plane of the undercarriage 2. This embodiment is distinguished particularly by an advantageously large, contiguous empty space in the center of the undercarriage, which is available for accommodating the necessary components, especially the traction equipment.

Figure 9:
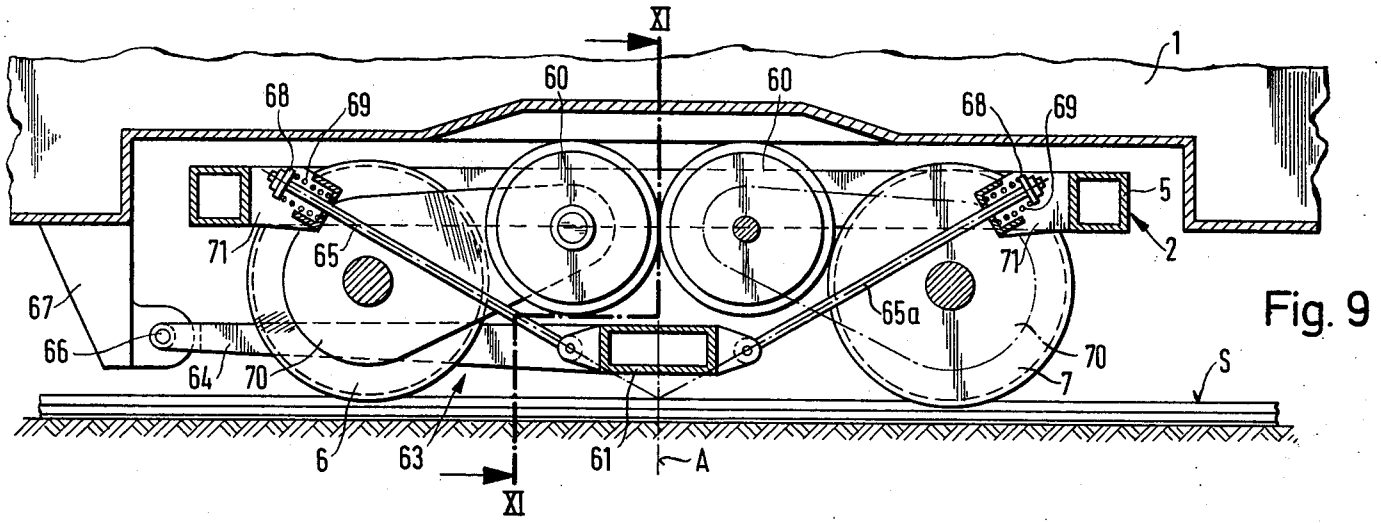
FIG. 9 illustrates a view taken on line IX—IX of FIG. 11.
Figure 10:
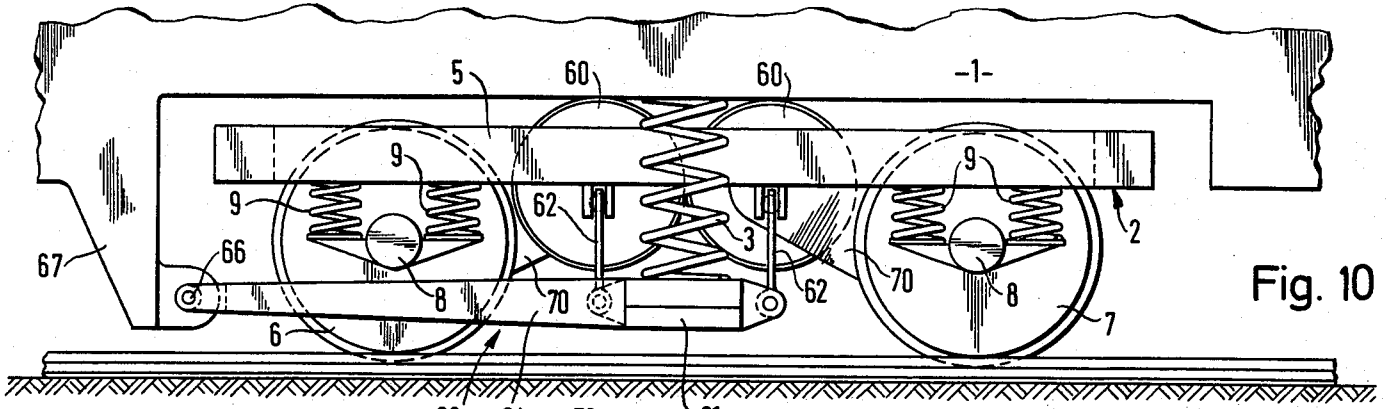
FIG. 10 illustrates a view similar to FIG. 1 wherein the intermediate member is a cross-piece for supporting a vehicle body via springs in accordance with the invention.
Figure 11:
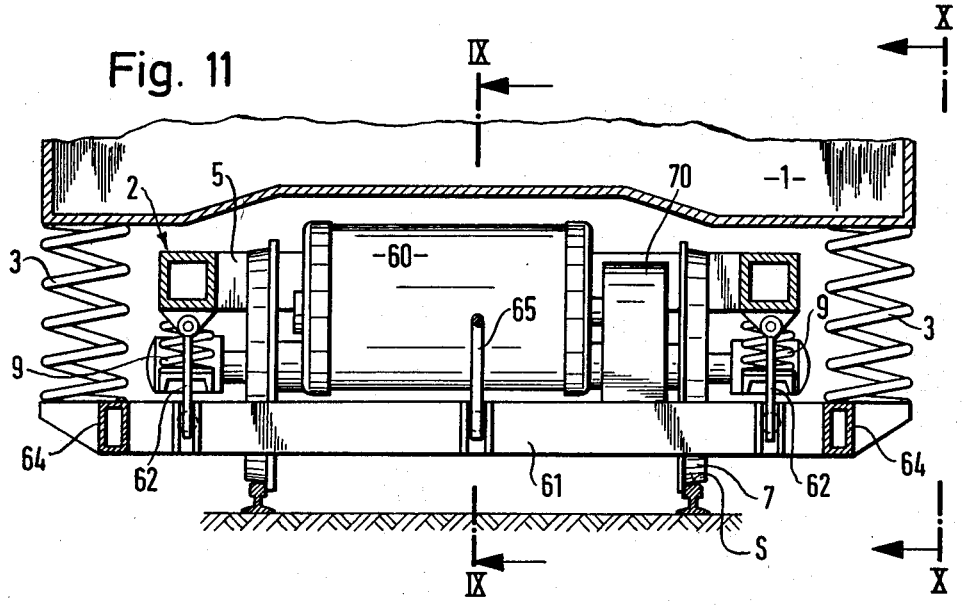
FIG. 11 illustrates a view taken on line XI—XI of FIG. 9.

Referring to FIGS. 9, 10 and 11, the vehicle body 1 can be supported via springs 3 on a cross piece 61, which is suspended from each of two longitudinal beams of the undercarriage frame 5 by means of two pendulums 62. Two drive motors are mounted on the undercarriage 2 and cooperate with one of the wheel sets 6 or 7 via a gear box 70. The cross piece 61 is coupled to the vehicle body 1 and the undercarriage 2 via a low-slung traction means 63. This traction means 63 comprises two horizontal arms 64 which are rigidly connected to the cross piece 61, and extend in the longitudinal direction and two tie rods 65, 65*a* which are inclined downward from the frame 5 in the vicinity of the lengthwise center plane toward the center of the undercarriage. The tie rods 65, 65*a* are linked to the cross piece 61 while the arms 64 are linked via a joint 66 each to a bracket 67 of the vehicle body 1. The other ends of the tie rods 65, 65*a* are supported to move in space on a bracket 71 arranged at the frame 5 via spring washers 68 and compression springs 69.

The joint 66 as well as the linkage points provided at the frame 5 and at the cross piece 61 for the pendulums 62 and the tie rods 65, 65*a* are constructed as ball joints which permit spatial movement of the cooperating parts. Accordingly, relative movements between the vehicle body 1 and the undercarriage 2 resulting from the spring play of the primary and secondary spring systems and which occur particularly when curves are negotiated, are made possible. The spring support of the tie rods 65, 65*a* compensates for the small changes of the joint distances which are produced by such relative movements like pitching, rocking and turning. The residual torque exerted by the traction and braking forces on the cross-piece 61 is compensated by the two pairs of pendulums 62.

Figure 14:
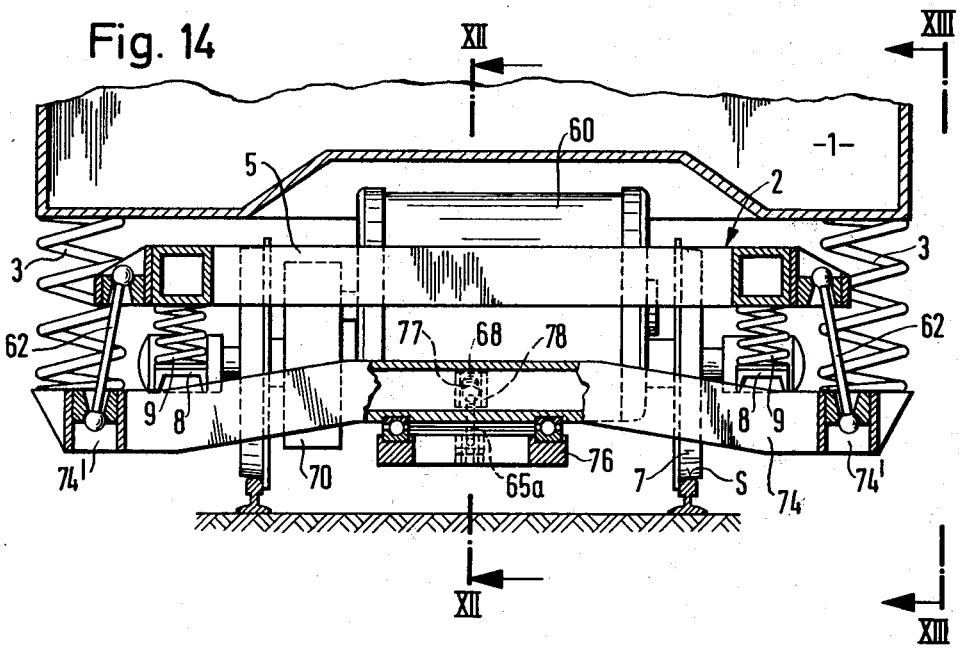
FIG. 14 illustrates a view taken on line XIV—XIV of FIG. 12.
Figure 12:
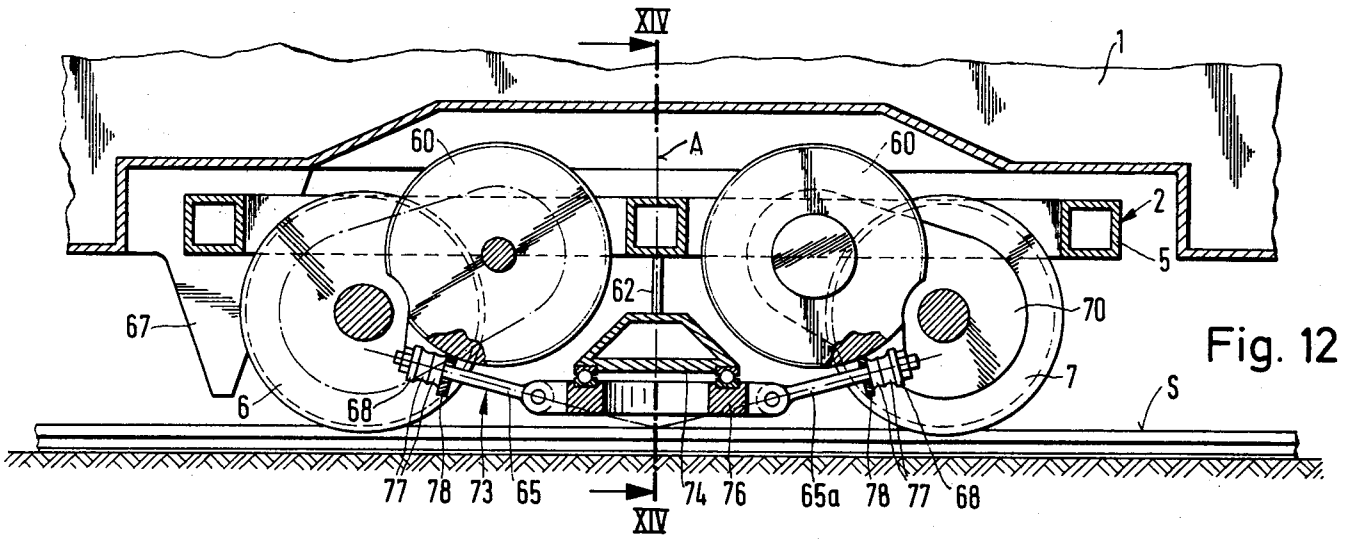
FIG. 12 illustrates a view taken on line XII—XII of FIG. 14.
Figure 13:
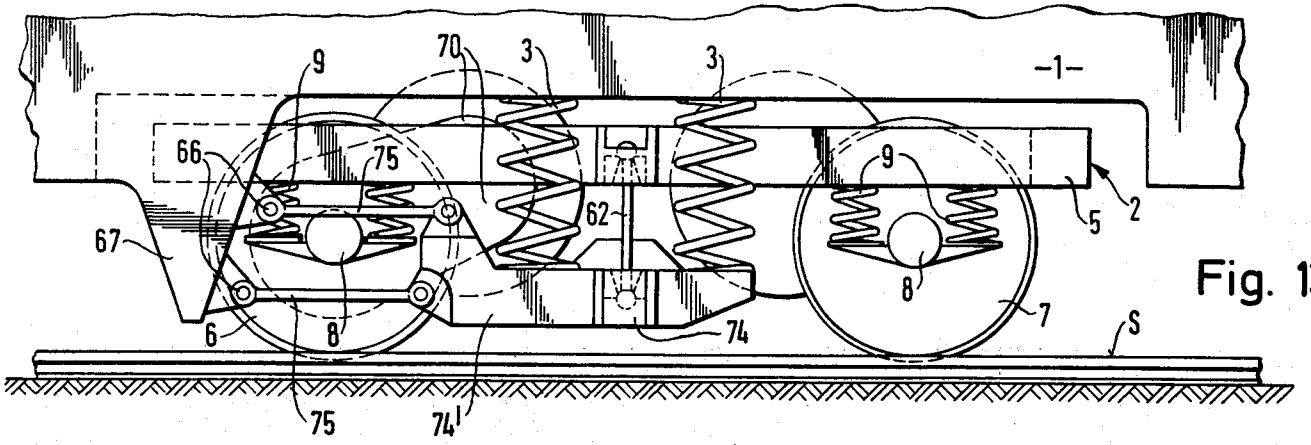
FIG. 13 illustrates a view similar to FIG. 1 of the traction means of FIG. 12.

Referring to FIGS. 12, 13 and 14, the vehicle body 1 can be supported via two pairs of springs 3 on a cross piece 74, which is suspended by means of two pendulums 62 from the frame 5. In this case, the low-slung traction means 73 comprises two pairs of parallel longitudinal guide rods 75 which are arranged on top of each other in parallel and are linked to the two ends 74' of the cross piece 74 and to the brackets 67 of the vehicle body 1, as well as a rotary ball bearing track 76 which is fastened to the cross piece 74 in the vicinity of the truck center to be rotatable about the vertical axis. The ball bearing track 76 is linked to the tie rods 65, 65*a*, while the other ends of the tie rods 65, 65*a* are braced to be movable in space via a rubber spring 77 on a bracket 78 provided at the housing of the drive motor 60. Also, the linkage points provided at the frame 5, the bracket 67 and the cross piece 74 are constructed as ball joints which, together with the spring 77, permit the described relative movements of the coupled vehicle parts. The residual torque exerted by the traction and braking forces on the cross piece 74 is taken up by two pairs of guide rods 75.

Referring to FIG. 15, instead of two tie rods, the low-slung traction means can also contain a single guide rod 81 which is inclined downward toward the center of the truck and is intended to transmit tension and compression forces. The guide rod 81 is linked to the cross piece 61 and to a bracket 82 provided at the housing of the motor 60 via a ball joint each. It is understood that, in this embodiment, no changes of the joint distances need to be considered and therefore, also no resilient connection is necessary.

For spring-cushioning the tie rods, several constructions are suitable. For example, as shown in FIG. 16, the compression spring 69 is arranged in a spring cup 84, which is linked at the frame 5 with a joint 85.

Still other different embodiments are possible. For example, a resilient linking-on of the tie rods can also be achieved by an arrangement in which pivots, guided in elongated holes, permit the described changes of the joint distances. The linkage for the transmission of the traction and braking forces can also be arranged laterally to the longitudinal center plane of the undercarriage, provided this is practical in connection with the arrangement of the drive units or other components.

In the embodiments according to FIGS. 12 to 15, hinge-like joints can be used instead of the three-dimensional joints 66 as well as at the linkage points of the guide rods 75 at the beam ends 74', by which the transversel forces acting between the vehicle body and the undercarriage are transmitted.

Embodiments are also possible, in which the connecting rods coupled to the intermediate member, for instance corresponding to the guide rods 27, 28 in FIG. 3, are linked to the vehicle body and the intermediate member. For instance, a pair of levers cooresponding to the levers 31, 32 in FIG. 3, can be movably connected to the undercarriage.

The traction means is also not confined to rail vehicles with undercarriages but can also be used in other vehicles, such as, for instance, in vehicles with single-axle undercarriages.

What is claimed is:

1. A rail vehicle comprising:

a vehicle body;

an undercarriage for supporting said body on a rail surface, and means for transmitting traction and braking forces between said body and said undercarriage, said means including at least one bar-like connecting rod movably connected to one of said body and said undercarriage and disposed longitudinally of said body, a movable intermediate member pivotably connected to said other of said body and said undercarriage about at least one substantially transverse axis and connected to said connecting rod, at least one tie rod inclined downwardly toward the center of said undercarriage, said the rod being pivotally connected between and to said intermediate member and said other of said body and said undercarriage and means for guiding said intermediate member in a vertical plane relative to said body to maintain the position of said intermediate member relative to said undercarriage.

2. A rail vehicle as set forth in claim 1 wherein said guiding means includes a linkage having a guide rod coupling said intermediate member to said one of said body and said undercarriage for transmission of a reaction force to generate a reaction moment to counteract a corresponding moment caused by one of a traction force and a braking force.

3. A rail vehicle as set forth in claim 2 wherein said traction and braking means further includes a pair of oppositely directed connecting rods inclined downwardly toward the center of said undercarriage, each said downwardly directed connecting rod being pivotably connected between and to said intermediate member and said other of said body and said undercarriage, and wherein said bar-like connecting rod and said guide rod are in parallel and are connected to said intermediate member at different elevations.

4. A rail vehicle as set forth in claim 1 wherein said intermediate member is disposed longitudinally and centrally of said undercarriage.

5. A rail vehicle as set forth in claim 1 which further comprises a rotary bearing connected to said body, a platform connected to said bearing for rotation relative to said body, and a bracket extending from said platform, said connecting rod being pivotably connected to said bracket.

6. A rail vehicle as set forth in claim 1 wherein said intermediate member is a cross-piece, wherein said traction and braking means includes a pair of pendulums suspending said cross-piece from said undercarriage and which further comprises springs between said cross-piece and said body for supporting said body on said cross-piece.

7. A rail vehicle as set forth in claim 1 which further comprises springs supporting said body on said undercarriage.

8. A rail vehicle comprising;

a vehicle body;

an undercarriage for supporting said body on a rail surface; and means for transmitting traction and braking forces between said body and said undercarriage, said means including at least one connecting rod movably connected to said body and disposed longitudinally of said body, a movable intermediate member pivotably connected to said undercarriage about at least one substantially transverse axis and connected to said connecting rod, at least one tie rod inclined downwardly toward the center of said undercarriage, said tie rod being pivotally connected between and to said intermediate member and said undercarriage and means for guiding said intermediate member in a vertical plane to maintain the position of said intermediate member relative to said undercarriage.

9. A rail vehicle as set forth in claim 8 wherein said guiding means includes a linkage having a guide rod coupling said intermediate member to said body for transmission of a reaction force to generate a reaction moment to counteract a corresponding moment caused by one of a traction force and braking force.

10. A rail vehicle comprising;

a vehicle body an undercarriage having a plurality of the wheelsets for supporting said body on a rail surface; and means for transmitting traction and braking forces between said body and said undercarriage for maintaining the load on said wheelsets, said means including an upwardly extending bracket on said undercarriage, a downwardly-extending bracket on said undercarriage, a pair of parallel guide rods, each said guide rod being linked to a respective bracket, and a movable intermediate member coupling said guide rods together and including a pair of two armed levers pivotally connected relative to said vehicle body and to each other at respective ends, each respective lever being connected to a respective guide rod.

11. A rail vehicle comprising;

a vehicle body;

an undercarriage for supporting said body on a rail surface; and means for transmitting traction and braking forces between said body and said undercarriage, said means including a bracket extending from said body, an intermediate member, a pair of parallel guide rods pivoted to said bracket and linked to said intermediate member for guiding said intermediate member in a vertical plane relative to said body, and a second pair of guide rods, each pivotally connected between said intermediate member and said undercarriage.

12. A rail vehicle as set forth in claim 11 wherein said intermediate member is T-shaped.

13. A rail vehicle as set forth in claim 11 wherein said intermediate member is a lever cross.

14. A rail vehicle comprising a vehicle body;

an undercarriage having a frame for supporting said body on a rail surface;

means for transmitting traction and braking forces between said body and said undercarriage, said means including a cross-piece suspended from said undercarriage, two pairs of parallel longitudinal guide rods, each said pair of guide rods being linked to one respective end of said cross-piece and to said body, a rotary ball bearing track supported on said frame and a pair of tie rods secured to said ball bearing track and to said undercarriage; and springs supporting said track on said frame.

15. A rail vehicle comprising a vehicle body;

an undercarriage for supporting said body on a rail surface; and means for transmitting traction and braking forces between said body and said undercarriage, said means including a pair of parallel connecting rods movably connected to one of said body and said undercarriage and disposed on top of each other longitudinally of said body, and a pair of two-arm levers pivotably connected to said other of said body and said undercarriage about at least one substantially transverse axis, each said lever being connected at one end to a respective one of said connecting rods and at an opposite end to each other, and wherein one of said levers has a lever arm of a different length from the remaining lever arms of said pair of levers to define a ratio of the lengths of said lever arms relative to each other proportional to the ratio of the elevations of said connecting rods above the upper edge of a track.

* * * * *

UNITED STATES PATENT AND TRADEMARK OFFICE

CERTIFICATE OF CORRECTION

PATENT NO. : 4,273,055

DATED : June 16, 1981

INVENTOR(S) : GASTON BORGEAUD ET AL

It is certified that error appears in the above—identified patent and that said Letters Patent is hereby corrected as shown below:

Column 5, lines 7 and 8, change "vertical" to --vehicle--

Column 8, line 36, change "the" to --tie--

Column 9, line 38, after "of" delete "the"

Signed and Sealed this

*Sixth* Day of *October 1981*

[SEAL]

*Attest:*

GERALD J. MOSSINGHOFF

*Attesting Officer*

*Commissioner of Patents and Trademarks*